United States Patent [19]

Bozek

[11] Patent Number: 4,858,588

[45] Date of Patent: Aug. 22, 1989

[54] ARCHERY DEVICE WITH SEPARATE BENDING AND LAUCHING BOWSTRINGS AND FRONT END ARROW LAUNCH

[76] Inventor: John W. Bozek, 6093 Waterfront Dr., Waterford, Mich. 48167

[21] Appl. No.: 234,473

[22] Filed: Aug. 22, 1988

Related U.S. Application Data

[63] Continuation-in-part of Ser. No. 109,736, Oct. 19, 1987, abandoned, which is a continuation-in-part of Ser. No. 871,793, Jun. 9, 1986, Pat. No. 4,757,799.

[51] Int. Cl.[4] ..... F41B 5/00

[52] U.S. Cl. ..... 124/23 R; 124/DIG. 1; 273/416

[58] Field of Search ..... 124/23 R, 24 R, DIG. 1; 273/416, 421

[56] References Cited

U.S. PATENT DOCUMENTS

| | | | |
|---|---|---|---|
| 2,432,209 | 12/1947 | Osgood | 273/416 |
| 3,238,935 | 3/1966 | Stanaland | 273/416 |
| 3,841,295 | 10/1974 | Hunter | 124/24 R |
| 3,987,777 | 10/1976 | Darlington | 124/23 R |
| 4,457,288 | 7/1984 | Ricord | 124/23 R |
| 4,465,054 | 8/1984 | Nishioka | 124/24 R |
| 4,471,747 | 9/1984 | Nishioka | 124/23 R |
| 4,530,342 | 7/1985 | Simo | 124/24 R |
| 4,757,799 | 7/1988 | Bozek | 124/DIG. 1 |

FOREIGN PATENT DOCUMENTS

| | | | |
|---|---|---|---|
| 691158 | 7/1964 | Canada | 273/DIG. 8 |
| 2441823 | 7/1980 | France | 273/416 |

*Primary Examiner*—Randolph A. Reese
*Assistant Examiner*—Anthony Knight
*Attorney, Agent, or Firm*—John R. Benefiel

[57] ABSTRACT

An archery device is disclosed utilizing separate bending and lauching bowstrings strung on a bow member, the launching bowstring closely positioned to the bow member in the undrawn condition to enable front end launching of an arrow engaged at its forward end by a split configuration of the launching bowstring, the arrow passing between bifurcated portions of the bow member when fired. The bending bowstring when drawn operates a system of rotary drive elements to cause highly leveraged flexing of pivoted limbs mounted at either end. The tips of the flexed limbs are fixed to the launching bowstring, and at firing, the bending drive system allows the flexed limbs to release their stored energy into the lauching bowstring to accelerate the arrow. The separate bending-launching bowstring system enables relatively great arrow accelerating forces to be developed, which are easily withstood by the arrow, since the forces are applied to the front end of the arrow. A special limp bodied or arrow or a rigid bodied arrow with a sliding head are used with the device.

11 Claims, 3 Drawing Sheets

ARCHERY DEVICE WITH SEPARATE BENDING AND LAUCHING BOWSTRINGS AND FRONT END ARROW LAUNCH

CROSS REFERENCE TO RELATED APPLICATIONS

This application is a continuation-in-part of Ser.No. 109,736, filed on Oct. 19, 1987, now abandoned which is a Continuation-in-part of Ser.No. 871,793 filed June 9, 1986 now U.S. Pat. No. 4,757,799.

BACKGROUND OF THE INVENTION

This invention concerns archery devices such as bows and cross bows in which limbs are flexed to create stored energy, which energy is released at firing to accelerate the arrow nocked to a bowstring connected to the limb tips.

In copending application Serial No. 871,793 filed June 9, 1986, of the present inventor, there is disclosed an arrangement for increasing the arrow accelerating forces able to be generated using separate bending and launching bowstrings. In that arrangement successive draws of the bending bowstring act to bend the limbs, with a bending mechanism affording a mechanical advantage to the user in drawing the bending bowstring to bend the limbs. The separate launching bowstring directly receives the stored energy of the flexed limbs at firing and the arrow is thus nocked to the launching bowstring.

In that arrangement, several successive draws of the bending bowstring are required to fully bend the limbs since the leveraging system, in reducing the draw effort necessitates a much greater draw distance over the normal range of drawing movement possible by an archer.

This necessitates the added complexity of a ratcheting-latching mechanism to allow the bending accomplished by each draw to be held and increased bending achieved by each successive draw.

While greatly increased accelerating forces are made possible by this arrangement, limitations are imposed by the conventional pushing or thrust mode used to launch the arrow. That is, the arrows are distorted by the application of the compressive accelerating forces at the rear end of the arrow which tend to compress the arrow causing it to bend. For the very high forces able to be generated in that device, this distortion tends to become excessive, and represents a practical limitation on the velocity achievable.

Even for conventional bows, the design of the arrow is dictated by the need to prevent excessive shaft bending resulting from the compressive load applied to the arrow. The tumbling tendency of the arrow when launched from the rear requires additional design effort. The tendency for bending and tumbling adversely affects the flight characteristics of the arrow, reducing accuracy and velocity. Finally, the length of the arrow is dictated by the practical draw length of an archer rather than aerodynamic or other performance considerations.

Accordingly, it is an object of the present invention to provide a bending-launching dual bowstring archery device in which a separate latching mechanism and successive draws are not required while allowing a leveraged action of the bending bowstring, to enable much higher peak accelerating forces to be exerted on the arrow.

It is another object of the present invention to provide an arrow launching system in which very high accelerating forces may be applied to the arrow, without any distortion thereof.

It is yet another object of the present invention to provide a front launch archery system for projectiles to eliminate the disadvantages of conventional archery devices.

SUMMARY OF THE INVENTION

These and other objects of the present invention are achieved by the arrangement of separate bending and launching bowstrings in an archery device including a bow member having oppositely extending limbs. The bending bowstring, when drawn operates a leveraged bending mechanism causing bending of the bow limbs.

A particular leveraged bending mechanism of the limbs enables highly efficient bending of the limbs, each of which is pivoted at a point intermediate their length thereof to have tip and butt ends. The bending drawstring, acting on disengageable drive wheels, rotates differential diameter reels, winding up and paying out cables connected to the limb tips and butts respectively to cause bending of the limbs over the intermediate points of support. The drive wheels are disengaged at firing to reduce losses in the launching system as the launching bowstring is snapped to the restored position by the limbs after release of the bending bowstring.

The launching bowstring is fixed at either end to a limb tip and is split to receive the body of an arrow and engage and retain the head during drawing. Accelerating forces are imparted only to the head of the arrow, loaded with tensile rather than compressive stresses. Thus, the nature of the launch of the arrow is referred to herein as the "traction" mode. The bending drawstring is drawn by the user simultaneously with the drawing of the rear or nocking end of the arrow to cause bending of the limbs. At release, the limbs snap to their restored position, causing the launching bowstring to also snap to the restored position, launching the arrow in the traction mode by applying the accelerating force solely to the head of the arrow. The bow member has bifurcated portions, allowing the arrow to pass between those portions when launched.

An order to accommodate this launching system, the arrow comprises in a first embodiment a limp-bodied arrow in which a wire, cord, or cable is connected to the penetrating head at one end, and a nocking-fletching element is provided at the other end, spanning the gap between the bending and launching bowstring in both the drawn and undrawn state. The nocking element is gripped by the fingers of the archer to enable the launching bowstring to be kept taut, as the bending bowstring bends the limbs and creates slack, which is thus taken up by drawing on the nocking element of the arrow.

The wire, cord, or cable body of the arrow itself is stretched taut during the drawing process, so as to accommodate the changing distance between the bending and launching bowstrings. The traction mode launch eliminates the need for stabilizing to overcome the tumbling tendency caused by the conventional rear launch, and also to overcome the instability caused by bending of a rigid shaft arrow caused by compressive forces.

The trailing wire, cable, or cord with minimal fletching is normally all that is needed to maintain the point first orientation of the head.

A rigid-bodied arrow is alternatively described, in which the head is slidably mounted to a rigid shaft, allowing the forward end of the arrow to be positioned well ahead of the arrow head which remains engaged with the split launching bowstring throughout the drawing step. This also thus accommodates the changing distance between the launching and bending bowstrings while maintaining the engagement of the launching bowstring with the arrow head.

DETAILED DESCRIPTION

In the following specification, certain specific terminology is employed for the sake of clarity and a particular embodiment described in accordance with the requirements of 35 USC 112, but it is to be understood that the same is not intended to be limiting, and should not be so construed inasmuch as the invention is capable of taking many forms and variations within the scope of the appended claims.

Figure 1:
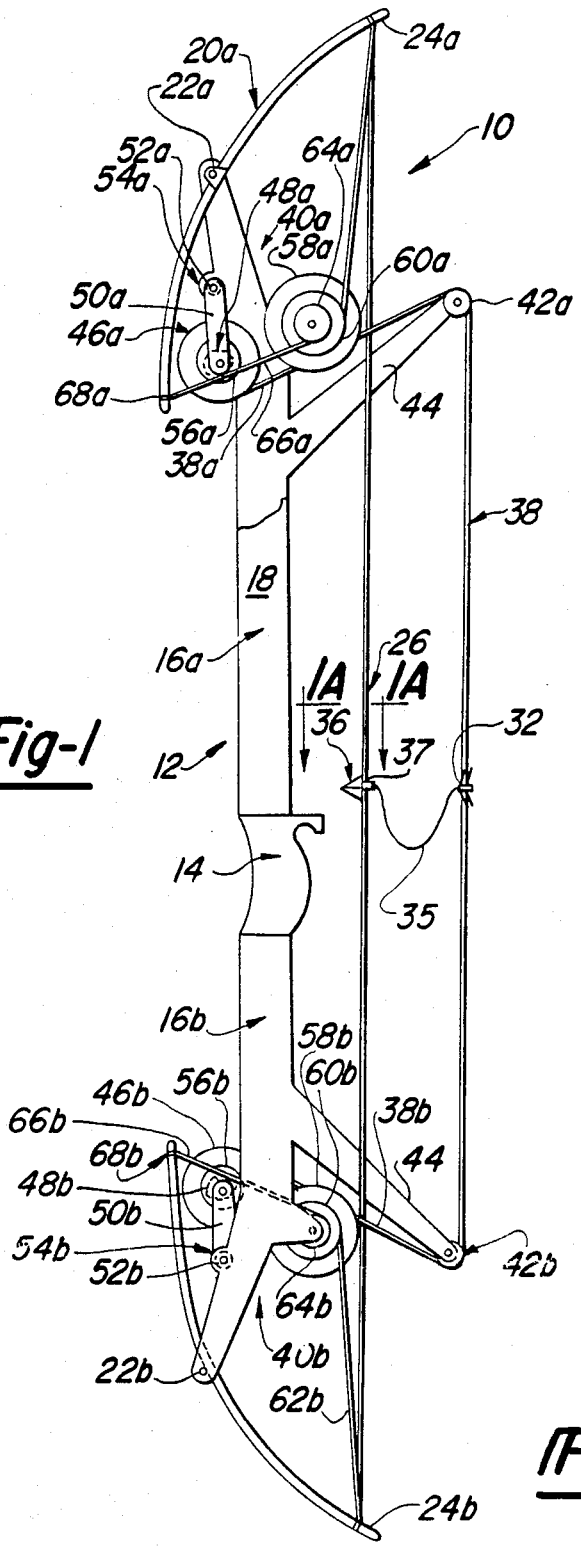
FIG. 1 is a side elevational view of an archery device according to the present invention, in the undrawn condition with a portion of the upper structure broken away to reveal otherwise concealed components.
Figure 2:
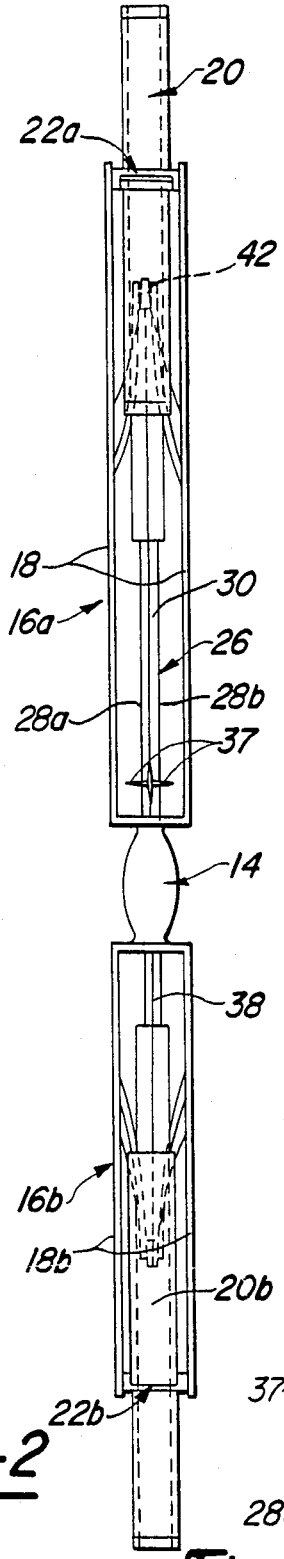
FIG. 2 is a front elevational view of the archery device shown in FIG. 1.

Referring to the Drawings, and particularly FIGS. 1 and 2, the archery device 10 includes a bow member 12 comprised of a central grip 14 shaped to be gripped by the hand of an archer, and upper and lower fork shaped limb supports 16*a* and 16*b* extending oppositely from the grip 14.

Each limb support 16*a* and 16*b* is formed of elongated members 18 spaced apart laterally to receive a respective blade shaped elongated bow limb 20. Each bow limb 20 is pivotally mounted at a point intermediate its length by means of a pivot axle 22 extending between the ends of each limb support member 18. The limbs 20 are constructed of a suitable material allowing limited flexing, such as metal or wood, since bending thereof is utilized to generate the arrow accelerating forces.

The limb tips 24*a*, 24*b* are connected by a split launching bowstring 26 comprised of separated strands 28*a*, 28*b* creating a central gap 30 therebetween. At launch, gap 30 allows the arrow 34 including a nocking element 32 and limp body portion 35 to pass through.

The launching energy is generated by bending or flexing of the limbs 20*a* and 20*b*, about their respective pivotal supports 22. The limb bending, according to the concept of the present invention, is accomplished by a separate bending bowstring 38, operating a pair of bending mechanisms 40*a* and 40*b*, upon being drawn by the archer. The bending bowstring 38 extends parallel to the launching drawstring 26, but spaced to the rear, by passing over respective pulleys 42*a*, 42*b* supported on rearwardly inclined pulley support arms 44*a*, 44*b* forming a portion of limb support members 18.

Each end portion 38*a*, 38*b* of the bending bowstring 38 is wound upon a respective take up reel 46*a*, 46*b*, included in bending mechanisms 40*a*, 40*b*, urged by torsion springs 48*a*, 48*b* to rotate so as to wind up thereon the ends 38*a*, 38*b* of the bending bowstring 38.

Each take up reel 46*a*, 46*b* is rotatably supported on a respective one of a pair of swing arms 50*a*, 50*b*, each pivoted from the ends of a respective pair of members 18 of limb supports 16*a*, 16*b* by pivot supports 52*a*, 52*b*. Retraction torsion springs 54*a*, 54*b* urge respective swing arms 50*a*, 50*b* to swing forwardly as viewed in FIG. 1.

A drive wheel 56*a*, 56*b* is also rotatably mounted on each swing arm 50*a*, 50*b* fixed to a respective take up reel 46*a*, 46*b* to be rotated therewith, but of a substantially smaller diameter.

Each drive wheel 56*a*, 56*b* is adapted to drive a respective driven wheel 58*a*, 58*b* rotatably mounted between the ends of limbs 18 of both limb supports 16*a*, 16*b*.

Upon drawing of the bending drawstring 38, the retraction torsion springs 54*a*, 54*b* are overcome and swing arms 50*a*, 50*b* are swung to the rear to engage drive wheels 56*a*, 56*b* with the respective driven wheels 58*a*, 58*b*. A driving rotary engagement is thereby established, as by friction or toothed gears in mesh.

The driven wheels 58*a*, 58*b* are of much larger diameter than the driving wheels 56*a*, 56*b*, so that a reduction drive is effected from one to the other.

Tip windlass reels 60*a*, 60*b* are fixed to rotate with the driven wheels 58*a*, 58*b* and each have a first short cable segment 62*a*, 62*b* wound thereon and connected to a limb tip 24*a*, 24*b* and butt windlass reels also are fixed to rotate therewith and have a second cable segment 66*a*, 66*b* connected to the butt end 68*a*, 68*b* of limbs 20*a*, 20*b*. The tip windlass reels 60*a*, 60*b* wind up the first cable segments 62*a*, 62*b* while the butt windlass reels 56*a* and 56*b* are unwinding the second cable segments 66*a*, 66*b*, but as the reels 60*a*, 60*b* are of greater diameter than reels 64*a*, 64*b*, a differential effect produces bending of the limbs 20*a*, 20*b* about the points of support 22*a*, 22*b*.

Figure 3:
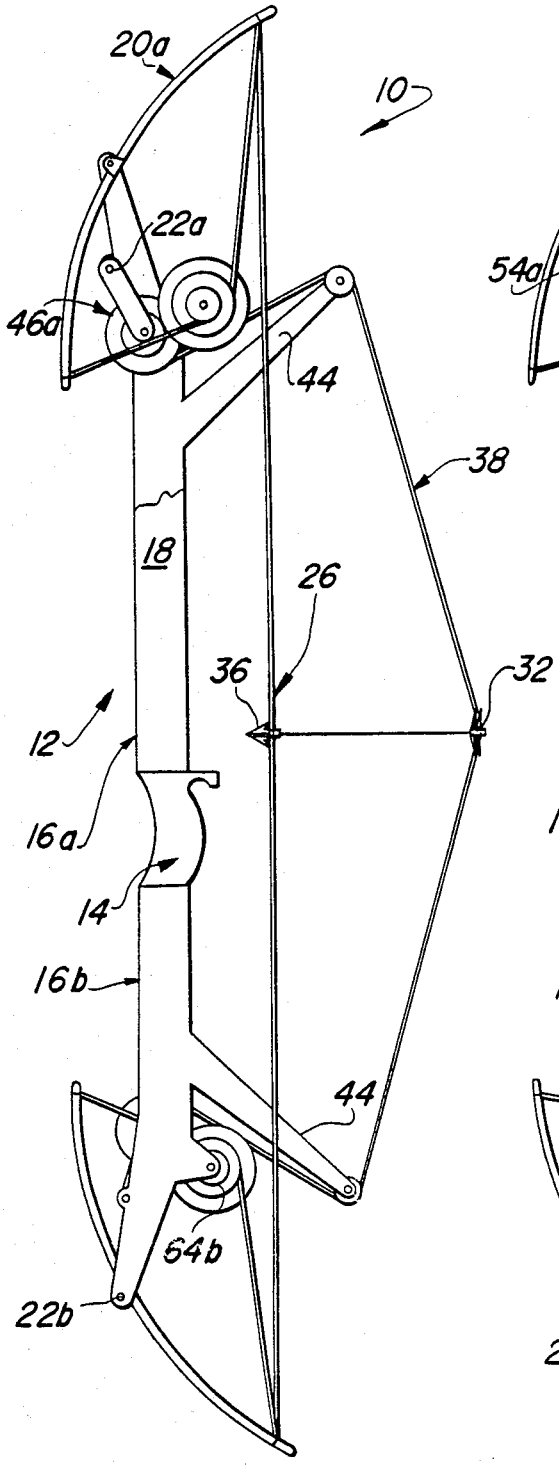
FIG. 3 is a side elevational view of the archery device shown in FIG. 1 with the bending bowstring at partial draw.

The bending occurs along the entire length of the limbs 20*a*, 20*b* and produces a considerable amount of travel of the launching bowstring 26 as the limbs 20*a*, 20*b* flex and tilt rearwardly with drawing motion of the bending bowstring 38 (see FIG. 3).

Figure 1A:
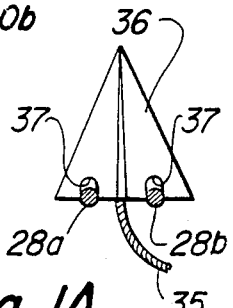
FIG. 1A is an enlarged view of the Section 1A—1A, showing the arrow head and engaged launching bowstring portions.
Figure 4:
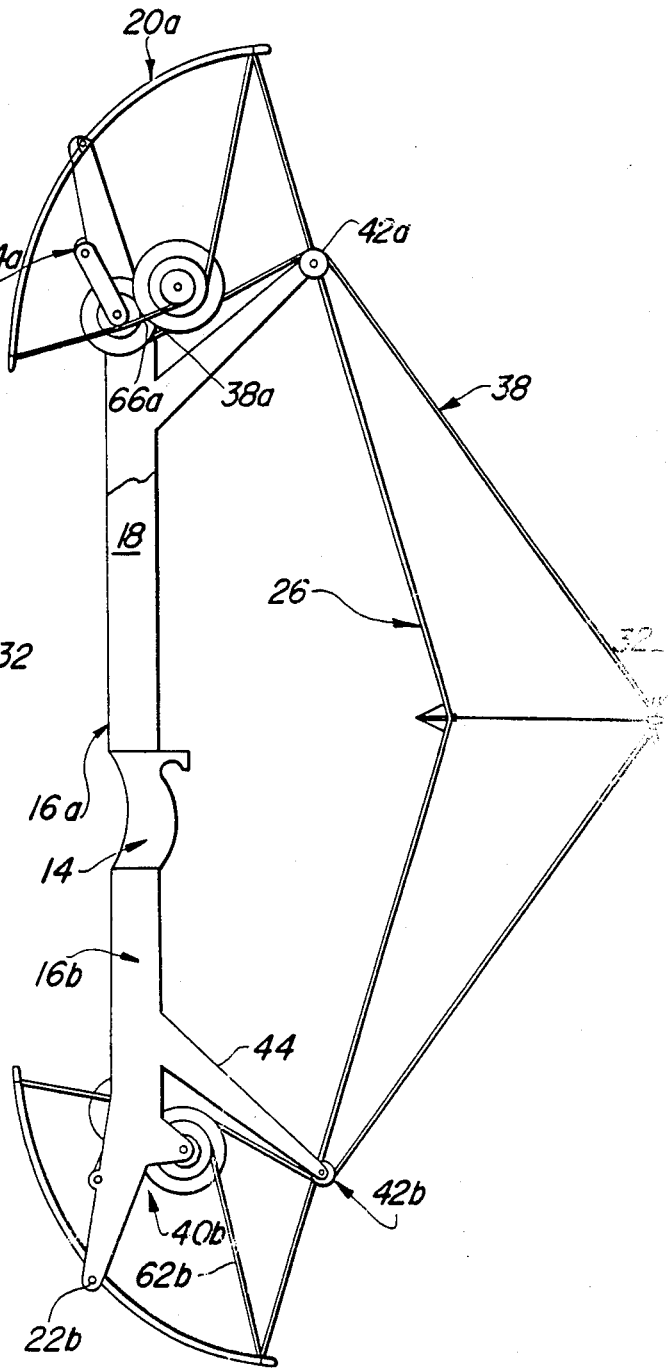
FIG. 4 is a side elevational view of the archery device shown in FIGS. 1 and 3 at full draw, but immediately after release of the bending bowstring.
Figure 5:
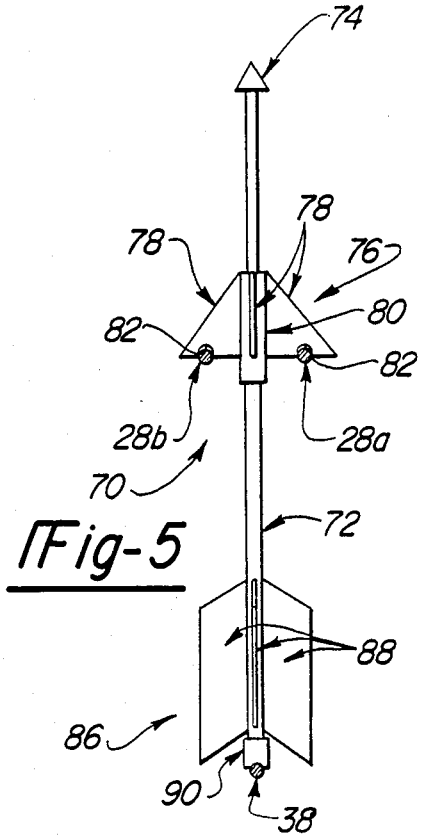
FIG. 5 is a plan view of a movable head rigid-bodied arrow alternatively useable with the traction mode launch archery device according to the present invention, shown in the position assumed at initiation of the draw.
Figure 6:
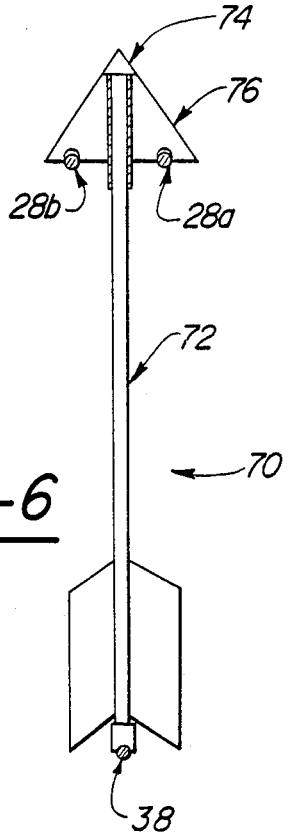
FIG. 6 is a plan view of the arrow of FIG. 5 shown in the position assumed at full draw.

As seen in FIG. 1A, the arrow 34 has its head 36 nocked on to each strand 28A, 28B of the launching bowstring 26 to be releasably held thereby. The head 36 is fixed to one end of the limp body 35, comprised of a length of wire, cable, cord, etc., which at its other end is fixed to a tail end portion 32 adapted to be nocked on bending bowstring 38. The tail end is preferably a light weight grooved plastic nocking element 32 with minimal fletching. The mass of the arrow 34 is concentrated almost entirely in the head 36, which is therefore preferably constructed of a heavy piece of metal. The nocking element 32 is held and is pulled to the rear as the bending bowstring 38 is drawn, stretching body 35 until the launching bowstring 26 is drawn taut as seen in FIG. 3. Both bending and launching bowstrings 38, 26 thereafter are moved to the rear until the fully drawn position is reached as seen in FIG. 4. The tension that is applied to the body 35 of the arrow 34 is minimal, as the only function of the body 35 is to take up the slack generated in the launching bowstring 26 as the bending bowstring 38 is drawn.

Upon release of the bending bowstring 38 and arrow 34, the swing arms 50*a*, 50*b* move forwardly disengaging the driving wheels 56*a*, 56*b* from the driven wheels 58*a*, 58*b*.

The stored energy in the flexed limbs 20*a*, 20*b* is released entirely in snapping the launching bowstring 26 forwardly, applying a tensile force which accelerates the arrow 34 from the head 36 at the front end thereof to launch the same in the traction mode.

The front end application of the tensile accelerating forces to the arrow 34 avoids the problem of conventional archery devices which impose compressive loading of a rigid bodied arrow, tending to tumble and bend it and deflect it from the intended flight path.

Thus very great accelerating forces may be applied to limp bodied arrows 34 which have no compressive strength.

The mass of the arrow 34 being concentrated almost entirely in the head 36, will fly true, the body 35 and nocking element 32 trailing behind the head 36 in similar fashion to a hammer throw. Thus trailing nock element 32 will keep the head 36 pointed in the direction of flight.

The use of highly leveraged bending by combining the bending bowstring with a bending mechanism and a separate launching bowstring enables generation of very high forces with only a reasonable exertion by the user.

It is noted that the particular bending mechanism disclosed generates a considerable amount of slack in the launching bowstring 26 as the limbs 20*a*, 20*b* are flexed. Also it has been found that the resistance felt by the bending bowstring 38 increases much more sharply so that successive draws are not required as in the aforementioned copending application Serial No. 871,793 now U.S. Pat. No. 4,757,799, while still obtaining a significant mechanical advantage of the bending drawstring 38 in flexing the limbs 20*a*, 20*b*. The launching bowstring 26 is positioned relatively close to the bow member 12 by the use of the limbs 20*a*, 20*b* mounted at an intermediate point so as to extend forwardly of the bow member. This allows a front end launch of the arrow 34 which as noted is grasped at the rear end at the beginning draw position.

The limp-bodied arrow 34 described above solves the problem of accommodating the changing distance between the launching bowstring 26 and the bending bowstring 38 as the bow 10 is drawn.

A second approach is to use a rigid arrow as shown in FIGS. 5–8. The arrow 70 includes an elongated rigid body 72, a small tip 74 is fixed to the forward end of the body 72, tip 74 projecting beyond the diameter of the body 72 to provide an axial stop. A head 76 is formed of crossing blades 78 mounted to a tube 80 slidably mounted on the arrow body 72.

Figure 7:
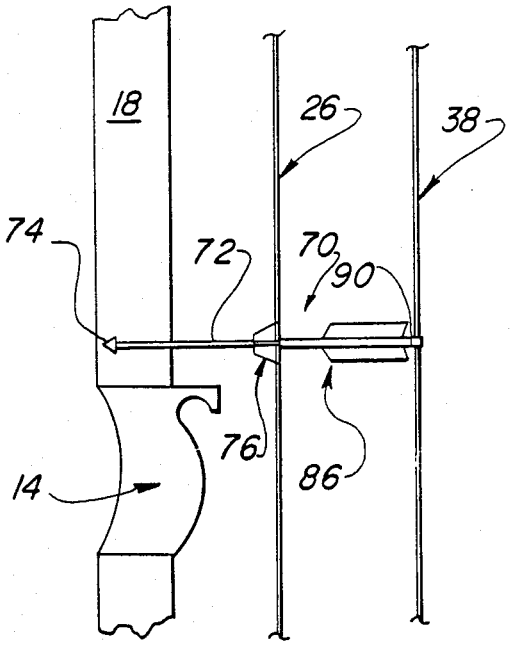
FIG. 7 is an elevational view of the arrow of FIGS. 5 and 6 and associated fragmentary portions of the archery device shown in the position assumed at the initiation of a draw.
Figure 8:
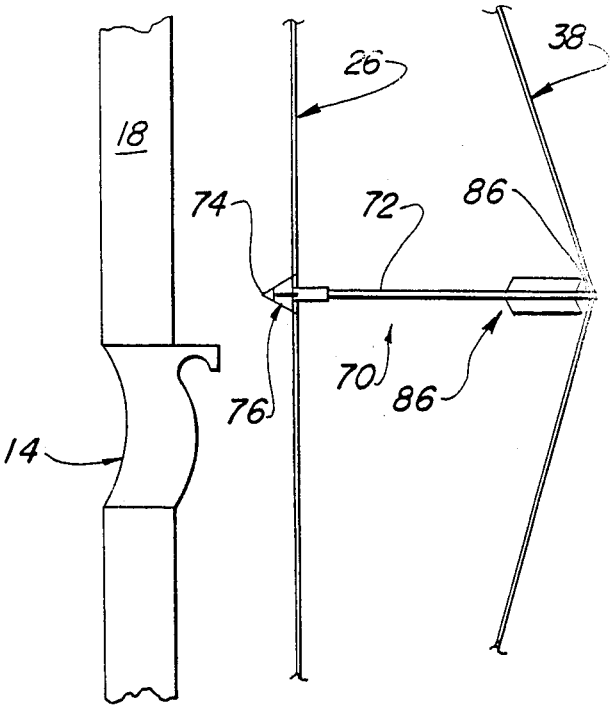
FIG. 8 is an elevational view of the arrow of FIGS. 5 and 6 and associated fragmentary portions of the archery device shown in the drawn position.

The head 76 is held on the strands 28*a*, 28*b* by pairs of grooves 82 formed into the rear edge of each blade 78. The head 76, being slidably mounted is able to be positioned to the rear of the tip 74 when initially positioned for drawing, as seen in FIG. 7.

The tail end 86 of the arrow 70 is provided with conventional fletching 88 and a nocking piece 90 adapted to receive the bending bowstring 38. Thus, as the tail end 86 is drawn with the bending bowstring 38, the head 76 is moved forwardly against the tip 74. The launching bowstring 26 at firing accelerates the head 76 to provide a traction mode launch, with no significant compressive loading of the body 72, thus avoiding the above described disadvantages.

Another alternative would be a telescoping sectioned construction (not shown).

I claim:

1. An archery device comprising:

an elongated bow member having a limb at either end, each terminating in a limb tip;

a launching bowstring fixed at either end to one of said limb tips;

a bending bowstring extending parallel to said launching bowstring;

a bending mechanism carried by each respective end of said bow member, drivingly engaging an end of said bending bowstring with a respective one of said limb tips;

each bending mechanism including means for bending a respective limb upon drawing movement of said bending bowstring while causing a mechanical advantage to be exerted by said bending bowstring in bending said limbs;

said bending mechanisms each further including a first windlass reel and a first cable wound thereon and fixed to an associated limb tip, and also including drive means rotating said first windlass reel upon drawing of said bending bow so as to wind said first cable onto said first windlass reel and thereby shorten said first cable and thereby bending an associated limb.

2. The archery device according to claim 1 wherein each of said bending mechanisms include means engaging said drive means upon drawing of said bending bowstring and disengaging said drive means upon release of said bending bowstring after drawing thereof.

3. The archery device according to claim 1 wherein each of said bending mechanisms includes a take-up reel having a respective end of said bending bowstring wound thereon and further including a drive wheel affixed to said take-up reel to rotate together therewith; each of said bending mechanisms further including a driven wheel fixed to rotate with said first windlass reel, and means mounting said drive and driven wheels to be engaged and rotated by drawing of said bending bowstring.

4. The archery device according to claim 3 further including a pair of pulley arms extending rearwardly from said bow member and a pulley mounted on each pulley arm, said pulleys located substantially at the rear of said limb tips and substantially inward therefrom, each pulley receiving a bending bowstring therefor, passing thence to a respective take-up reel, whereby said bending bowstring is spared to the rear of said launching bowstring and of a substantially shorter span.

5. The archery device according to claim 1 wherein each of said bending mechanisms include a second windlass reel fixed to rotate with said first windlass reel and a second cable wound on said second windlass reel so as to be unwound as said first windlass reel winds said first cable thereon; wherein each of said bow limbs is pivotally mounted at a point intermediate their length onto said bow member to have a butt end forward of said limb tip, said second cables affixed at one end to a respective limb butt end; said first windlass reel of a greater diameter than said second windlass reel whereby a resulting differential winding and unwinding bends said limb tips about said pivotal mounts.

6. The archery device according to claim 5 wherein said take-up reel and drive wheel are movably mounted as an assembly so as to cause said drive wheel to engage said driven wheel upon tensioning of said bending bowstring, and further including spring means resiliently urging said take-up reel and drive wheel opposite from the direction of tension exerted by said bending bowstring.

7. An archery system including an elongated arrow to be projected, said arrow having a body portion, and a head and nocking element mounted on said body portion, said system also including:

an elongated bow member having a central holder portion and opposite limbs each ending in a respective limb tip;

a launching bowstring mounted extending generally parallel to said bow member between said limb tips;

a bending bowstring extending parallel to and spaced to the rear of said launching bowstring and drivingly engaged with said limbs to cause bending hereof upon drawing of said bending bowstring;

means for engaging the head portion of said arrow with said launching bowstring;

said nocking element engageable with said bending bowstring;

said nocking element relatively movable axially from said arrow head as said bending bowstring is drawn, said bending bowstring moving relatively to the rear of said launching bowstring as said bending bowstring is drawn;

a clearance space in said bow member located to enable passage of said arrow upon firing.

8. The archery system according to claim 7 wherein said means for engaging said arrow head portion includes a split launching bowstring enabling said arrow to be received therebetween.

9. The archery system according to claim 8 wherein said bow member is formed with bifurcated portions defining said clearance space.

10. The archery system according to claim 7 wherein said arrow body is a length of limp-bodied material connecting said head and said nocking element.

11. An archery device comprising:

an elongated bow member having a limb at either end, each terminating in a limb tip;

a launching bowstring fixed at either end to one of said limb tips;

a bending bowstring extending parallel to said launching bowstring;

a bending mechanism carried by each respective end of said bow member, drivingly engaging an end of said bending bowstring with a respective one of said limb tips;

each bending mechanism including means for bending a respective limb upon drawing movement of said bending bowstring while causing a mechanical advantage to be exerted by said bending bowstring in bending said limbs;

each of said bending mechanisms also including means for drivingly disengaging said bending bowstring from each of said limb tips upon release of said bending bowstring at firing.

* * * * *

UNITED STATES PATENT AND TRADEMARK OFFICE

CERTIFICATE OF CORRECTION

PATENT NO. : 4,858,588

DATED : August 22, 1989

INVENTOR(S) : John W. Bozek

It is certified that error appears in the above-identified patent and that said Letters Patent is hereby corrected as shown below:

Column 1, lines 20-21, "copending application Serial No. 871,793, filed June 9, 1986" should be --U. S. Patent No. 4,757,799--.

Column 7, line 34 (Claim 7), "hereof" should be --thereof--.

Signed and Sealed this

Tenth Day of July, 1990

*Attest:*

*Attesting Officer*

HARRY F. MANBECK, JR.

*Commissioner of Patents and Trademarks*